US011101604B2

(12) United States Patent
Machida

(10) Patent No.: US 11,101,604 B2
(45) Date of Patent: Aug. 24, 2021

(54) CONNECTOR

(71) Applicant: Yazaki Corporation, Tokyo (JP)

(72) Inventor: Kengo Machida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/908,713

(22) Filed: Jun. 22, 2020

(65) Prior Publication Data

US 2020/0412063 A1 Dec. 31, 2020

(30) Foreign Application Priority Data

Jun. 25, 2019 (JP) ..... JP2019-117589

(51) Int. Cl.

| | |
|---|---|
| ***H01R 13/6581*** | (2011.01) |
| ***H01R 4/18*** | (2006.01) |
| ***H01R 13/52*** | (2006.01) |
| ***H01R 13/6591*** | (2011.01) |

(52) U.S. Cl.

CPC ..... *H01R 13/6581* (2013.01); *H01R 4/18* (2013.01); *H01R 13/5205* (2013.01); *H01R 13/6591* (2013.01)

(58) Field of Classification Search

CPC ..... H01R 13/6581; H01R 13/5205; H01R 13/6591; H01R 4/18

USPC ..... 439/521

See application file for complete search history.

(56) References Cited

U.S. PATENT DOCUMENTS

| | | | | |
|---|---|---|---|---|
| 5,190,474 | A * | 3/1993 | Ginet | H01R 24/50 439/581 |
| 6,921,292 | B2 * | 7/2005 | Miyazaki | H01R 9/032 439/564 |
| 7,507,125 | B2 * | 3/2009 | Okamura | H01R 13/506 439/680 |
| 8,485,844 | B2 * | 7/2013 | Omae | H01R 13/6585 439/559 |
| 8,840,428 | B2 * | 9/2014 | Omae | H01R 13/506 439/582 |
| 9,039,463 | B2 * | 5/2015 | Yamashita | H01R 13/187 439/852 |
| 9,124,024 | B2 * | 9/2015 | Itsuki | H01R 24/20 |
| 9,209,582 | B2 * | 12/2015 | Kashiwada | H01R 24/76 |
| 9,368,902 | B2 * | 6/2016 | Nakai | H01R 43/24 |

(Continued)

FOREIGN PATENT DOCUMENTS

JP 2015-15167 A 1/2015

*Primary Examiner* — Peter G Leigh
(74) *Attorney, Agent, or Firm* — Kenealy Vaidya LLP

(57) ABSTRACT

A connector includes a housing that allows a terminal lead-out and an electric wire lead-out to be drawn outward in a direction orthogonal to a connector insertion/removal direction, a shield shell, and a male screw member that secures the shield shell to a fixture base in a state where the connector mating is completed when the connector insertion/removal direction is defined as a screw axis, in which the shield shell includes a first shell and a second shell each of which having a through hole respectively that allows insertion of the male screw member and configured to sandwich the housing in the connector insertion/removal direction, and includes a first pressing plate and a second pressing plate that grip the terminal lead-out in the connector insertion/removal direction in the state where the connector mating is completed.

6 Claims, 11 Drawing Sheets

(56) References Cited

U.S. PATENT DOCUMENTS

| | | | | |
|---|---|---|---|---|
| 9,391,389 | B2 * | 7/2016 | Ohmori | H01R 13/5202 |
| 9,455,523 | B1 * | 9/2016 | Sundarakrishnamachari | H01R 13/62927 |
| 9,620,899 | B2 * | 4/2017 | Kato | H01R 13/6315 |
| 10,153,584 | B2 * | 12/2018 | Iwabe | H01R 13/631 |
| 2017/0054248 | A1 * | 2/2017 | Moseke | H01R 13/504 |
| 2019/0109408 | A1 * | 4/2019 | Maddens | H01R 13/5025 |
| 2019/0190188 | A1 * | 6/2019 | Iwabe | H01R 13/5213 |
| 2019/0190211 | A1 * | 6/2019 | Yamanashi | H01R 13/502 |
| 2020/0212613 | A1 * | 7/2020 | Hirakawa | H01R 4/184 |
| 2020/0381861 | A1 * | 12/2020 | Tanaka | H01R 24/20 |

* cited by examiner

CONNECTOR

CROSS-REFERENCE TO RELATED APPLICATION(S)

The present application claims priority to and incorporates by reference the entire contents of Japanese Patent Application No. 2019-117589 filed in Japan on Jun. 25, 2019.

BACKGROUND OF THE INVENTION

1. Field of the Invention

The present invention relates to a connector.

2. Description of the Related Art

Connectors are sometimes used in environments where external inputs can be applied. Therefore, a conventional connector internally holds an electric wire by a housing, a shield shell, or the like, and suppresses transmission of the external input applied to a portion drawn out of the electric wire to the connection terminal side, and thereby enhances vibration resistance. In addition, the conventional connector is screwed to be secured to the side of a counterpart connector while having mating connection with the counterpart connector so as to suppress transmission of external input to a mating connection portion, and thereby enhances vibration resistance (Refer to Japanese Patent Application Laid-open No. 2015-15167). In this manner, there is a need to enhance the vibration resistance under any usage environment of the conventional connector. However, the conventional connector has room for improvement in enhancing the vibration resistance.

SUMMARY OF THE INVENTION

In view of this, the present invention aims to provide a connector capable of conveniently enhancing the vibration resistance.

In order to achieve the above mentioned object, a connector according to one aspect of the present invention includes a conductive connection terminal including a terminal connecting portion that is inserted into or removed from a counterpart connection terminal in a connector insertion/removal direction with respect to a counterpart connector and including an electric wire connecting portion that is physically and electrically connected to an end of an electric wire; a conductive cylindrical shield terminal that covers the end of the electric wire coaxially from an outer peripheral surface side and configured to be physically and electrically connected to a shield member of the electric wire; an insulating cylindrical waterproof member coaxially interposed between the shield terminal and the end of the electric wire; an insulating housing including a first container that houses the connection terminal and including a second container that houses the shield terminal and the end of the electric wire aligned along an axis in a direction orthogonal to the connector insertion/removal direction and that is configured to allow a terminal lead-out of the shield terminal and an electric wire lead-out of the end of the electric wire to be drawn outward in the orthogonal direction; a conductive shield shell that houses the housing, the terminal lead-out, and the wire lead-out; and a male screw member that secures the shield shell to a fixture base on the counterpart connector side in a state where the connector mating with the counterpart connector is completed when the connector insertion/removal direction is defined as a screw axis, wherein the shield shell includes a first shell and a second shell each of which having a through hole that allows insertion of the male screw member and configured to sandwich the housing in the connector insertion/removal direction, and includes a first pressing plate and a second pressing plate that grip the terminal lead-out in the connector insertion/removal direction in the state where the connector mating is completed.

According to another aspect of the present invention, in the connector, it is desirable that at least one of the first pressing plate and the second pressing plate includes a pressing portion projecting toward an outer peripheral surface of the terminal lead-out so as to apply a pressing force onto the outer peripheral surface of the terminal lead-out in a state where the connector mating is completed.

According to still another aspect of the present invention, in the connector, it is desirable that the first pressing plate is formed integrally with the first shell as a part of the first shell, and the second pressing plate is formed integrally with the second shell as a part of the second shell.

According to still another aspect of the present invention, in the connector, it is desirable that the first pressing plate is formed as a component separate from the first shell, the second pressing plate is formed as a component separate from the second shell, and the first shell and the second shell are configured to allow the first pressing plate and the second pressing plate to be gripped in the connector insertion/removal direction in a state where the connector mating is completed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a connector according to the present invention will be described below in detail with reference to the drawings. Note that the present invention is not limited by the present embodiment.

EMBODIMENT

One embodiment of a connector according to the present invention will be described with reference to FIGS. 1 to 11.

Reference sign 1 in FIGS. 1 to 6 indicates a connector of the present embodiment. The connector 1 is physically and electrically connected to a counterpart connector (not illustrated) as a mating connection target. The counterpart connector is included in a device to be electrically connected via the connector 1 (hereinafter, referred to as an "electrical connection target"), provided on a casing (not illustrated) of the electrical connection target (not illustrated). The electrical connection target may be any object as long as the object can be a target for electrical connection via the connector 1. The counterpart connector has a counterpart housing (not illustrated) provided on the casing of the electrical connection target, and a counterpart connection terminal (not illustrated) is arranged inside a counterpart mating portion of the counterpart housing.

Figure 2:
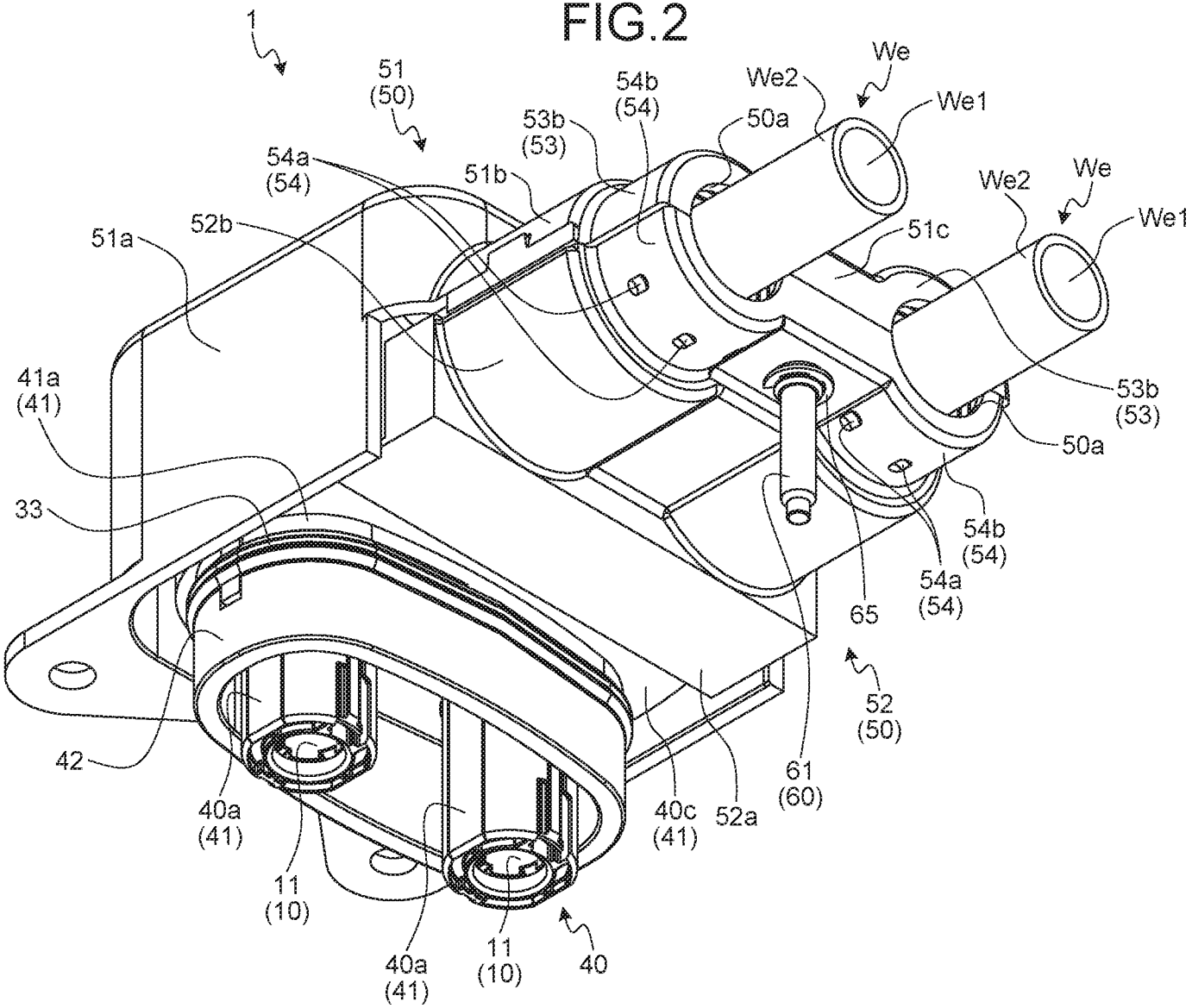
FIG. 2 is a perspective view of a connector of an embodiment as viewed from another angle.
Figure 3:
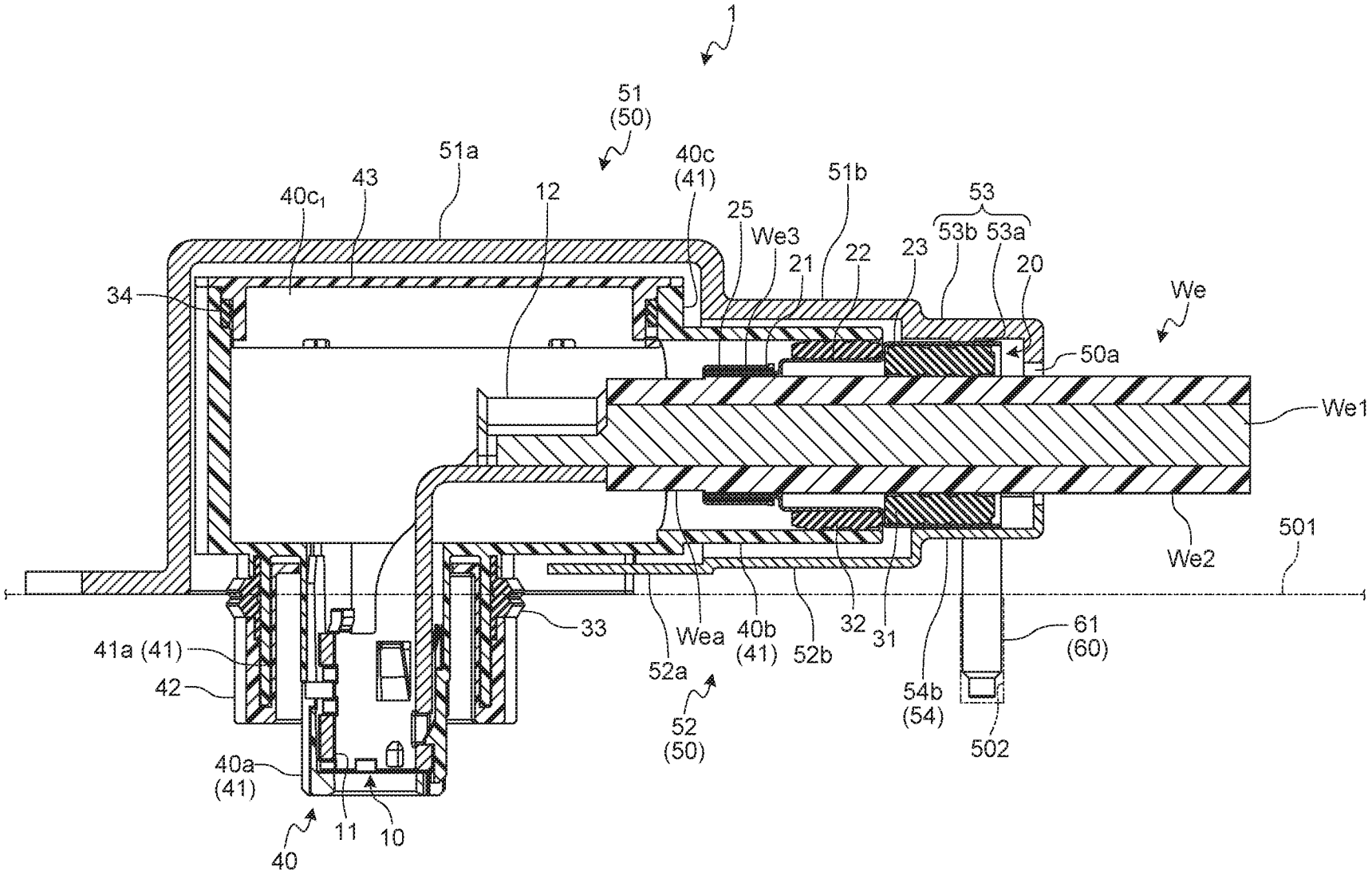
FIG. 3 is a cross-sectional view taken along line X-X of FIG. 1.
Figure 7:
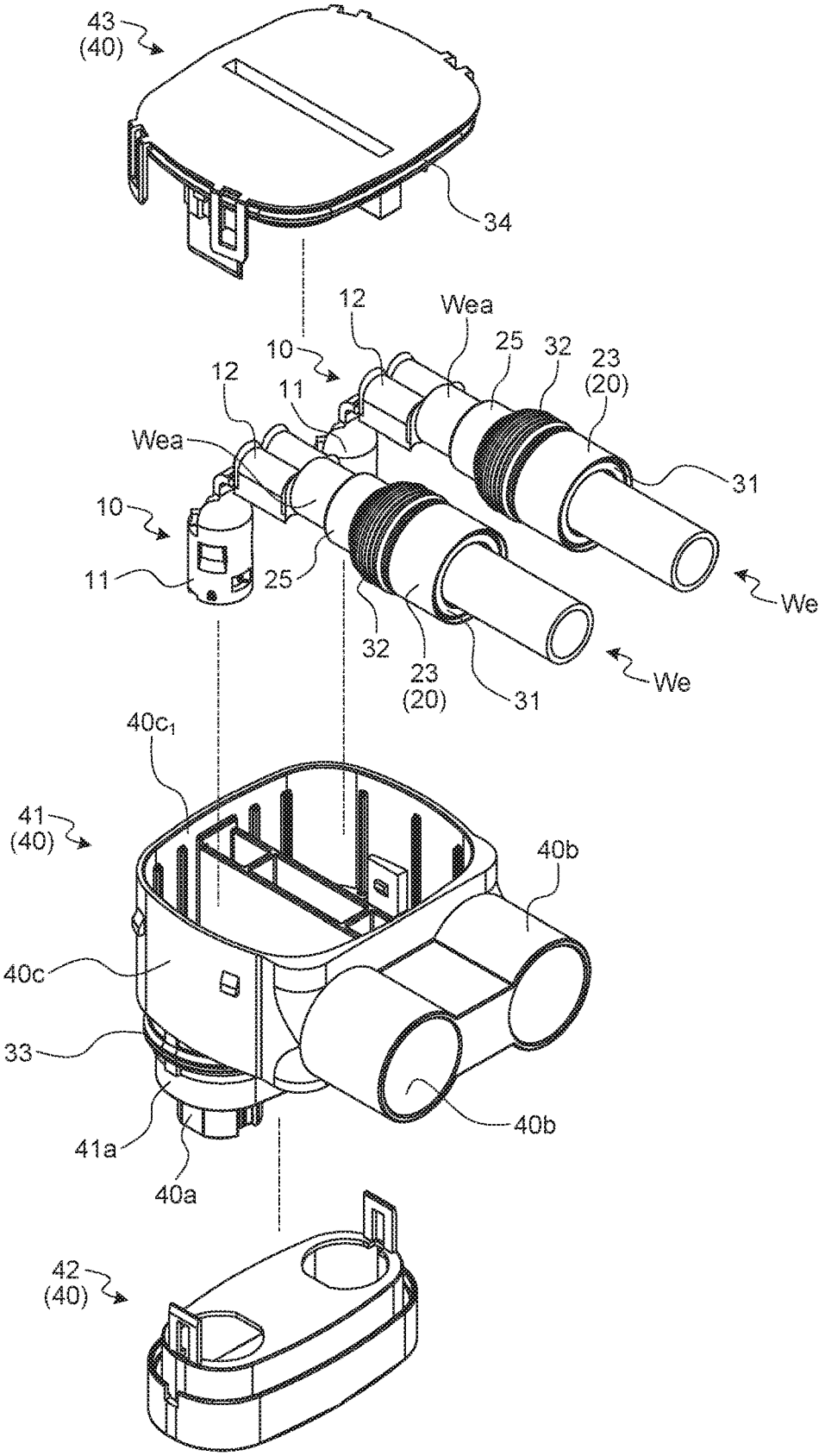
FIG. 7 is an exploded perspective view of a housing side.

The connector 1 includes a conductive connection terminal 10 that is physically and electrically connected to the counterpart connection terminal (FIGS. 2, 3, and 7). The connection terminal 10 may be formed with a plurality of conductive components assembled together, or may be formed as one terminal fitting. Here is an example of applying the connection terminal 10 formed as a terminal fitting using a conductive material such as a metal.

The connection terminal 10 includes a terminal connecting portion 11 that is inserted into and removed from the counterpart connection terminal in a connector insertion/removal direction (connector insertion direction/connector removal direction) with respect to the counterpart connector (FIGS. 2, 3, and 7). The terminal connecting portion 11 and the terminal connecting portion (not illustrated) of the counterpart connection terminal are joined with each other by mating connection in the connector insertion direction and are thereby physically and electrically connected to each other, and the mutual electrical connecting states are canceled by removing each other from the electrical connecting states in the connector removal direction. For example, one of the terminal connecting portion 11 or the terminal connecting portion of the counterpart connection terminal is formed in a female terminal shape, and the other is formed in a male terminal shape. Here, the terminal connecting portion 11 is formed in a female terminal shape, while the terminal connecting portion of the counterpart connection terminal is formed in a male terminal shape. In the following, the connector insertion direction refers to the connector insertion direction of the connector 1 with respect to the counterpart connector unless otherwise specified. In the following, the connector removal direction refers to the connector removal direction of the connector 1 with respect to the counterpart connector unless otherwise specified.

Furthermore, the connection terminal 10 includes an electric wire connecting portion 12 that is physically and electrically connected to the end of an electric wire We (FIGS. 3 and 7). The electric wire connecting portion 12 is for physically and electrically connecting a bare core wire We1 at the end of the electric wire We, and may have a connection in any manner. For example, the electric wire connecting portion 12 may be crimped to the bare core wire We1 by caulking or the like, or may be fixed by welding or the like. Here, the electric wire connecting portion 12 is crimped to the bare core wire We1. The end of the electric wire We is drawn out, in its own axial direction, from the electric wire connecting portion 12.

In this connection terminal 10, the connector insertion/removal direction in the terminal connecting portion 11 (in other words, the terminal insertion/removal direction with respect to the terminal connecting portion of the counterpart connection terminal) and a drawing direction of the end of the electric wire We from the electric wire connecting portion 12 are set to be orthogonal to each other. Therefore, the connection terminal 10 is formed in an L-shape in which the terminal connecting portion 11 and the electric wire connecting portion 12 are orthogonal to each other.

This exemplary connector 1 includes a plurality of combinations of a pair of the connection terminal 10 and the electric wire We. Here, two combinations of this pair are provided.

Figure 8:
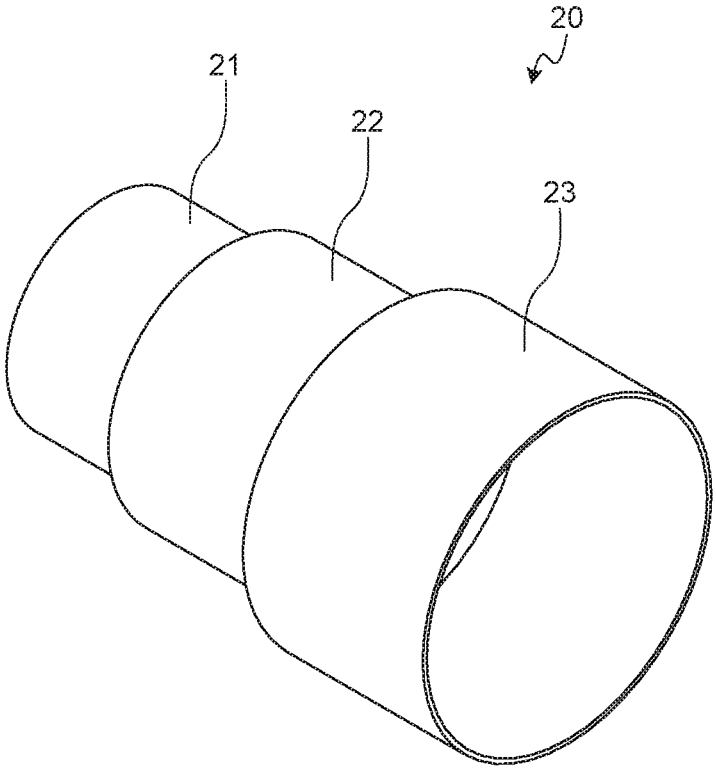
FIG. 8 is a perspective view illustrating a shield terminal.

The connector 1 includes a conductive cylindrical shield terminal 20 that covers the end of the electric wire We coaxially from an outer peripheral surface side (FIGS. 3, 4, 6, 7, and 8). The shield terminal 20 is formed of a conductive material such as a metal. The shield terminal 20 is provided for each of the electric wires We, so as to be disposed at the end of the electric wire We, at a tip of the electric wire We drawn out of the electric wire connecting portion 12. The shield terminal 20 has both ends open in the cylinder axis direction. The exemplary shield terminal 20 includes: a first cylinder 21 having an inner diameter equivalent to the outer diameter of the end of the electric wire We; a second cylinder 22 having an inner diameter and an outer diameter larger than in the first cylinder 21; and a third cylinder 23 having an inner diameter and an outer diameter larger than in the second cylinder 22 (FIGS. 3, 7, and 8). In this shield terminal 20, the first cylinder 21, the second cylinder 22, and the third cylinder 23 are coaxially arranged in this order. In this shield terminal 20, the first cylinder 21 is arranged on the electric wire connecting portion 12 side, with a coating We2 of the end of the electric wire We being coaxially and sequentially covered by the cylinders in order from the first cylinder 21 in the drawing direction from the electric wire connecting portion 12.

The shield terminal 20 is physically and electrically connected to a shield member We3 of the electric wire We (FIG. 3). The shield member We3 is a cylindrically braided member formed of a conductive material such as a metal, for example, and is coaxially arranged in the radial direction outside the core wire We1. This shield member We3 is configured to cover the outer peripheral surface of the first cylinder 21 of the shield terminal 20.

The connector 1 includes a cylindrical connecting member 25 that is fitted to the outer peripheral surface of the first cylinder 21 in a state where the shield member We3 is interposed between the outer peripheral surface of the first cylinder 21 and the connecting member 25 (FIG. 3 and FIG. 7). The connecting member 25 is formed of a conductive material such as a metal, for example. The connecting member 25 has both ends open in a cylinder axis direction. The connecting member 25 has an inner diameter formed to be equivalent to the outer diameter of the first cylinder 21, and is fitted to the outer peripheral surface of the first cylinder 21, thereby allowing the shield member We3 interposed between the first cylinder 21 and the connecting member 25 to be physically and electrically connected to the first cylinder 21.

Figure 4:
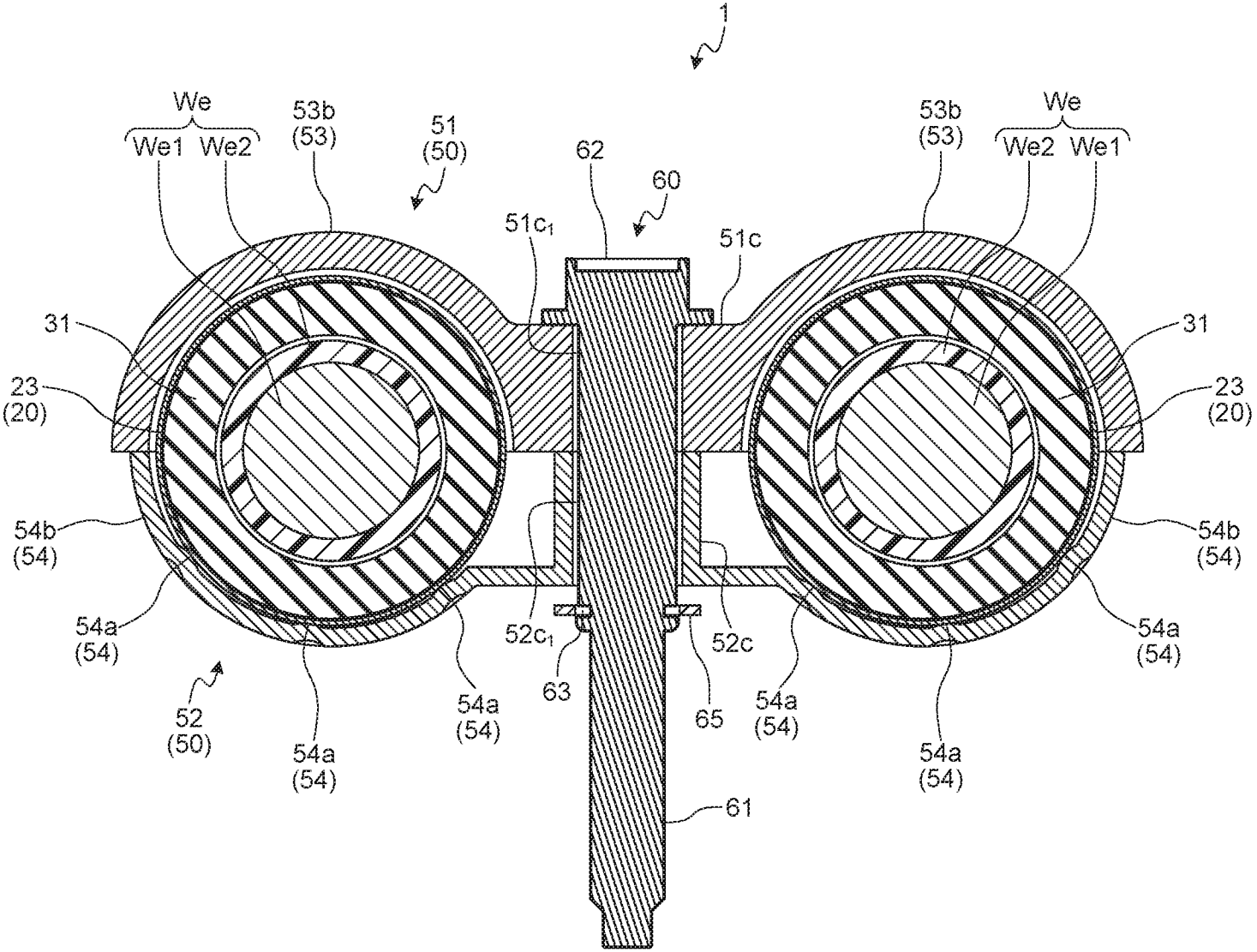
FIG. 4 is a cross-sectional view taken along line Y-Y of FIG. 1.

The connector 1 includes an insulating cylindrical waterproof member (hereinafter, referred to as a "first waterproof member") 31 coaxially interposed between the shield terminal 20 and the end of the electric wire We (FIGS. 3, 4 and 7). The first waterproof member 31 is a rubber plug, prepared to suppress intrusion of a liquid such as water to a portion between the shield terminal 20 and the end of the electric wire We. The first waterproof member 31 allows its both ends in the cylinder axis direction to open, with its lip on the outer peripheral surface coming into close contact with the inner peripheral surface of the shield terminal 20, and with its lip on the inner peripheral surface coming into close contact with the outer peripheral surface of the coating We2 at the end of the electric wire We. The exemplary first waterproof member 31 is interposed between the third cylinder 23 of the shield terminal 20 and the end of the electric wire We (that is, between a terminal lead-out and an electric wire lead-out Wea described below).

The connector 1 includes a housing 40 that houses the connection terminal 10, the shield terminal 20, and the end of the electric wire We (FIGS. 1 to 3 and FIGS. 5 to 7). The housing 40 is formed of an insulating material such as a synthetic resin.

The housing 40 includes a first container 40*a* that contains the connection terminal 10 (FIGS. 1 to 3 and FIGS. 5 to 7). The terminal connecting portion 11 of the connection terminal 10 is contained in a space (first chamber) inside the first container 40*a*. The exemplary first container 40*a* is formed in a cylindrical shape having its cylinder axis direction aligned with the connector insertion/removal direction (terminal insertion/removal direction), and is provided for each of the connection terminals 10. The first container 40*a* has both ends open in the cylinder axis direction. The two first containers 40*a* are arranged in a direction orthogonal to the connector insertion/removal direction (terminal insertion/removal direction) and the drawing direction of the end of the electric wire We from the electric wire connecting portion 12.

Furthermore, the housing 40 includes a second container 40*b* that contains the shield terminal 20 and the end of the electric wire We with its axis aligned with a direction orthogonal to the connector insertion/removal direction (terminal insertion/removal direction) and that allows the terminal lead-out of the shield terminal 20 and the electric wire lead-out Wea at the end of the electric wire We to be drawn outward in the orthogonal direction (FIGS. 3 and 5 to 7). The exemplary second container 40*b* is formed in a cylindrical shape in which the cylinder axial direction is aligned with the cylinder axis direction of the shield terminal 20 and the axis direction of the end of the electric wire We, and is provided for each of the electric wires We. The second container 40*b* has both ends open in the cylinder axis direction. The two second containers 40*b* are arranged in a direction orthogonal to the connector insertion/removal direction (terminal insertion/removal direction) and the drawing direction of the end of the electric wire We from the electric wire connecting portion 12.

Here, the terminal lead-out of the shield terminal 20 refers to a portion of the shield terminal 20 that is drawn out of the housing 40. Here, the third cylinder 23 corresponds to the terminal lead-out. Therefore, the first cylinder 21 and the second cylinder 22 of the shield terminal 20 are contained in the space (second chamber) inside the second container 40*b*. Furthermore, an electric wire lead-out Wea of the end of the electric wire We refers to a portion that is drawn out of the housing 40 at the end of the electric wire We. After being drawn out of the housing 40 together with the third cylinder 23, the electric wire lead-out Wea is also drawn out of the third cylinder 23.

The connector 1 includes an insulating cylindrical waterproof member (hereinafter, referred to as a "second waterproof member") 32 coaxially interposed between the shield terminal 20 and the housing 40 (FIGS. 3 and 7). The second waterproof member 32 is a rubber plug, prepared to suppress intrusion of a liquid such as water to a portion between the shield terminal 20 and the housing 40. The second waterproof member 32 allows its both ends in the cylinder axis direction to open, with its lip on the outer peripheral surface coming into close contact with the inner peripheral surface of the housing 40, and its lip on the inner peripheral surface coming into close contact with the outer peripheral surface of the shield terminal 20. The exemplary second waterproof member 32 is interposed between the second cylinder 22 of the shield terminal 20 and the second container 40*b* of the housing 40.

Furthermore, the housing 40 includes a third container 40*c* interposed between the first container 40*a* and the second container 40*b* so as to allow communication between an inner space (a third chamber) with the first chamber and the second chamber (FIGS. 2, 3, and 5 to 7). The third chamber houses the electric wire connecting portion 12 of the connection terminal 10 and the core wire We1 to which the electric wire connecting portion 12 is crimped. The exemplary third container 40*c* is formed in a rectangular tube shape with its cylinder axis direction aligned with the connector insertion/removal direction (terminal insertion/removal direction), and has an opening $\mathbf{40}c_1$ at a connector removal direction-side end (FIG. 3 and FIG. 7). The third container 40*c* has an opening, for each of the first containers 40*a*, that allows the two first containers 40*a* to protrude in the same direction from the connector insertion direction-side end and that allows communication from the connector insertion direction-side end to the first chamber. Furthermore, the third container 40*c* has an opening, for each of the second containers 40*b*, that allows two second containers 40*b* to protrude from a peripheral wall in the same direction and that allows communication from the peripheral wall to the second chamber. The exemplary third container 40*c* includes a third chamber formed for each of the connection terminals 10 (for each of the electric wires We).

The exemplary housing 40 includes the first container 40*a*, the second container 40*b*, and the third container 40*c* formed in a housing body 41 (FIGS. 1 to 3, 5, and 7).

The housing body 41 includes a tubular portion 41*a* that is formed in an oval tubular shape in which the cylinder axis direction of the housing is aligned with the connector insertion/removal direction (terminal insertion/removal direction), and in which the two first containers 40*a* are disposed (FIGS. 2, 3 and 7). The exemplary tubular portion 41*a* is configured to protrude from the connector insertion direction-side end of the third container 40*c* in the connector insertion direction and has the connector insertion direction-side end open. The tubular portion 41*a* has, on its outer peripheral surface, a coaxial annular waterproof member (hereinafter, referred to as a "third waterproof member") 33 (FIGS. 2, 3, and 7). The third waterproof member 33 is provided to ensure liquid tightness with the counterpart connector. The third waterproof member 33 is locked by an insulating tube-shaped tubular member 42 coaxially fitted into the tubular portion 41*a* (FIGS. 1 to 3 and FIGS. 5 to 7).

Figure 5:
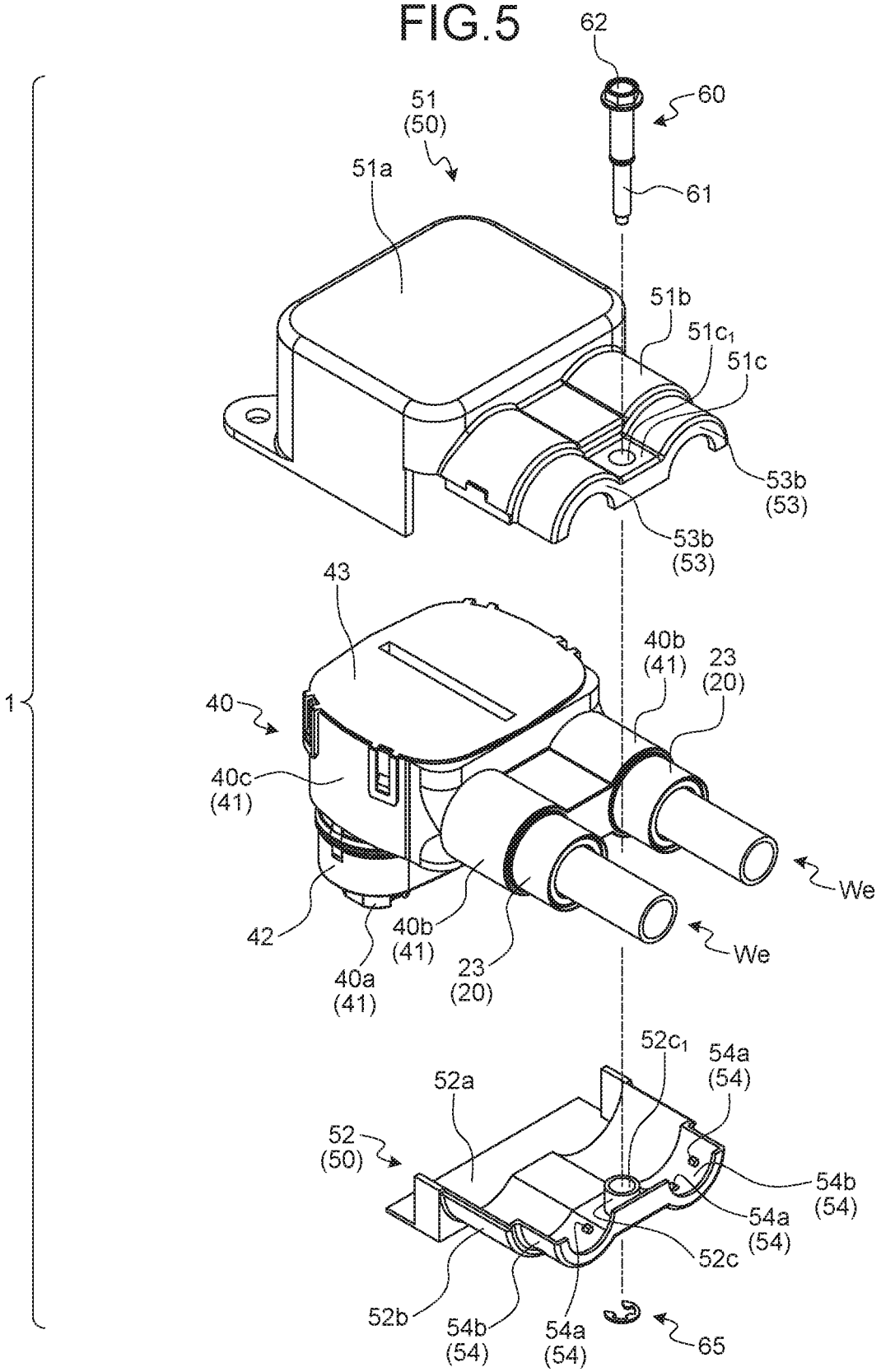
FIG. 5 is an exploded perspective view illustrating a state before assembly of a shield shell.
Figure 6:
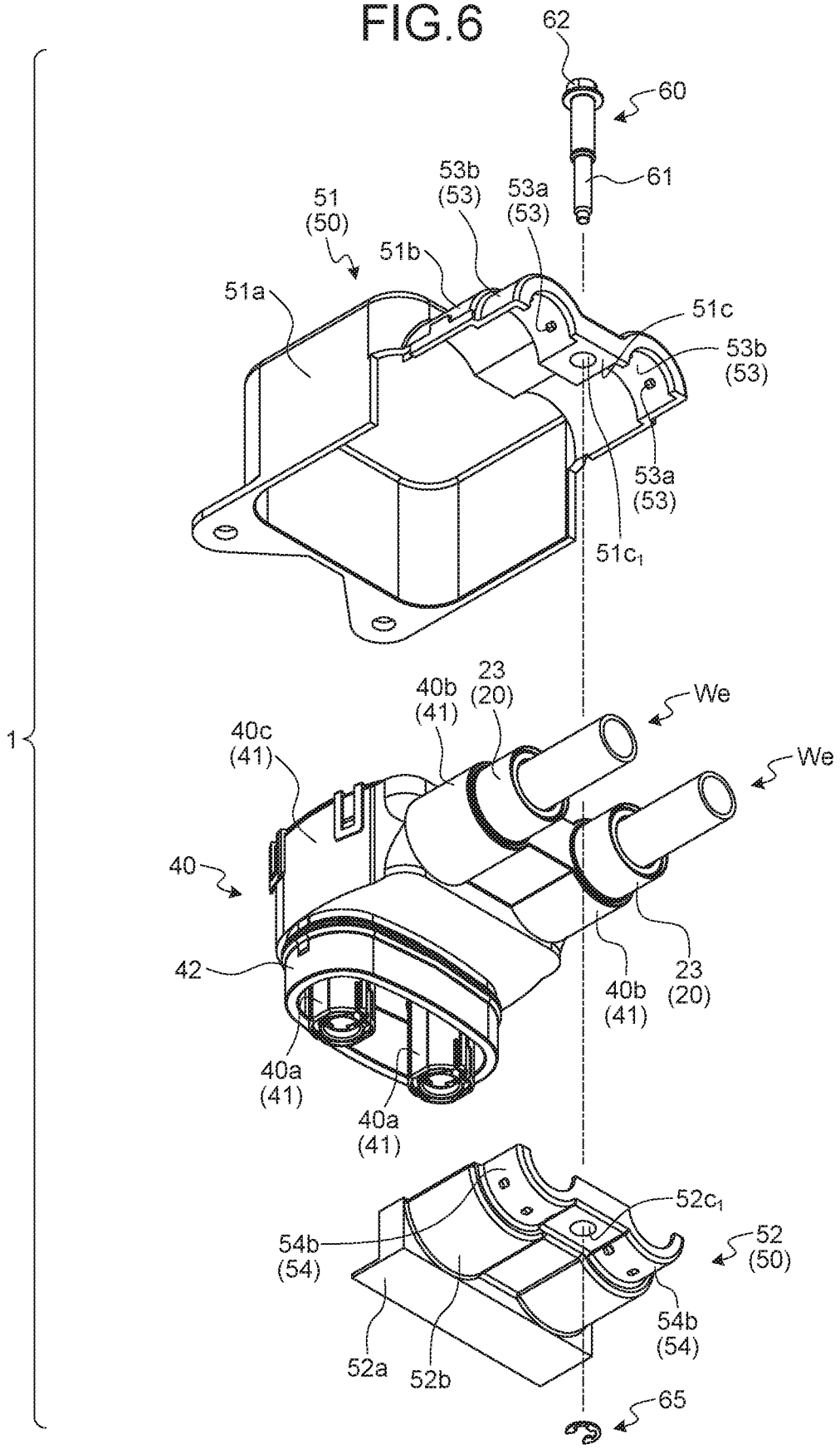
FIG. 6 is an exploded perspective view illustrating a state before assembly of the shield shell as viewed from another angle.

The housing 40 includes an insulating lid member 43 that closes the opening $\mathbf{40}c_1$ of the third container 40*c* (FIGS. 3, 5, and 7). An annular waterproof member (hereinafter, referred to as a "fourth waterproof member") 34 is provided between the opening $\mathbf{40}c_1$ and the lid member 43 (FIGS. 3 and 7).

The connector 1 further includes a conductive shield shell 50 that contains the housing 40, the third cylinder (terminal lead-out) 23 of the shield terminal 20, and the electric wire lead-out Wea at the end of the electric wire We (FIGS. 1 to 6, 9 and 10). The connector 1 includes a male screw member 60 that secures the shield shell 50 to a fixture base 501 (FIG. 3) of the counterpart connector in a state where the connector mating with the counterpart connector is completed when the connector insertion/removal direction is defined as a screw axis (FIGS. 1 to 6).

The shield shell 50 houses the housing 40, the third cylinder (terminal lead-out) 23 of the shield terminal 20, and the electric wire lead-out Wea at the end of the electric wire We, and covers these from the outside, thereby suppressing the intrusion of external noise to the inside. Accordingly, the shield shell 50 is formed of a conductive material such as a metal.

The shield shell 50 includes a first shell 51 and a second shell 52 that sandwich the housing 40 in the connector insertion/removal direction (terminal insertion/removal direction), and includes a first pressing plate 53 and a second pressing plate 54 that grip the third cylinder (terminal lead-out) 23 in the connector insertion/removal direction in a state where connector mating is completed (FIGS. 1 to 6). The shield shell 50 allows the male screw member 60 to be inserted between the third cylinders (terminal lead-outs) 23 of the two shield terminals 20, and then allows a male screw portion 61 of the male screw member 60 (FIGS. 2 to 6) to be screwed into a female screw portion 502 (FIG. 3) of the fixture base 501 on the counterpart connector side, thereby fixing the connector to the fixture base 501.

The first shell 51 has a first shell cover 51*a* that covers the third container 40*c* of the housing body 41 and the lid member 43 from the lid member 43 side (FIGS. 1 to 3, 5, and 9). The exemplary first shell cover 51*a* is formed in a rectangular tube shape having its cylinder axis direction aligned with the connector insertion/removal direction (terminal insertion/removal direction), and houses the third container 40*c* and the lid member 43. The first shell cover 51*a* has a connector insertion direction-side end open.

The first shell 51 further includes a second shell cover 51*b* that covers the two second containers 40*b* of the housing body 41 from the connector removal direction side (FIGS. 1 to 3, 5, and 9). The second shell cover 51*b* has a semicircular arc-shaped cross section orthogonal to the cylinder axis direction of the second container 40*b* at a location covering each of the second containers 40*b*.

Figure 9:
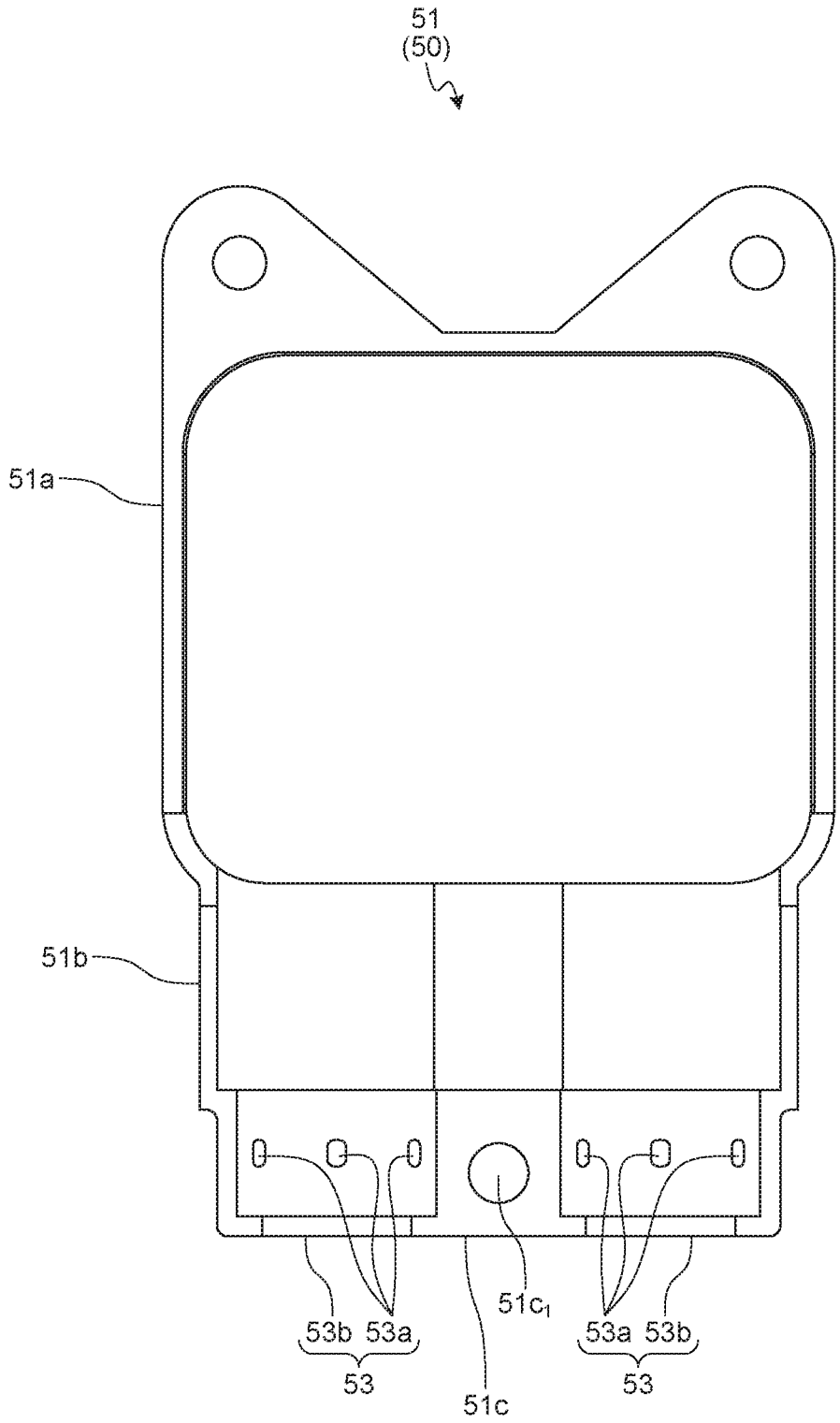
FIG. 9 is an internal plan view of a first shell.

The first shell 51 includes a receiving member 51*c* disposed between the two third cylinders (terminal lead-outs) 23 of the two shield terminals 20 and configured to receive an axial force from the bearing surface of a head 62 of the male screw member 60 (FIGS. 1, 4, 5, and 9). The receiving member 51*c* has a through hole $51c_1$ that allows insertion of the male screw member 60 (FIGS. 4, 5, and 9).

The second shell 52 includes a first shell cover 52*a* that covers a connector insertion direction-side end of the third container 40*c* of the housing body 41 on the second container 40*b* side, from the connector insertion direction side (FIGS. 1 to 3, 5, and 10).

The second shell 52 further includes a second shell cover 52*b* that covers the two second containers 40*b* of the housing body 41 from the connector insertion direction side (FIGS. 1 to 3, 5, and 10). The second shell cover 52*b* has a semicircular arc-shaped cross section orthogonal to the cylinder axis direction of the second container 40*b* at a location covering each of the second containers 40*b*.

Figure 10:
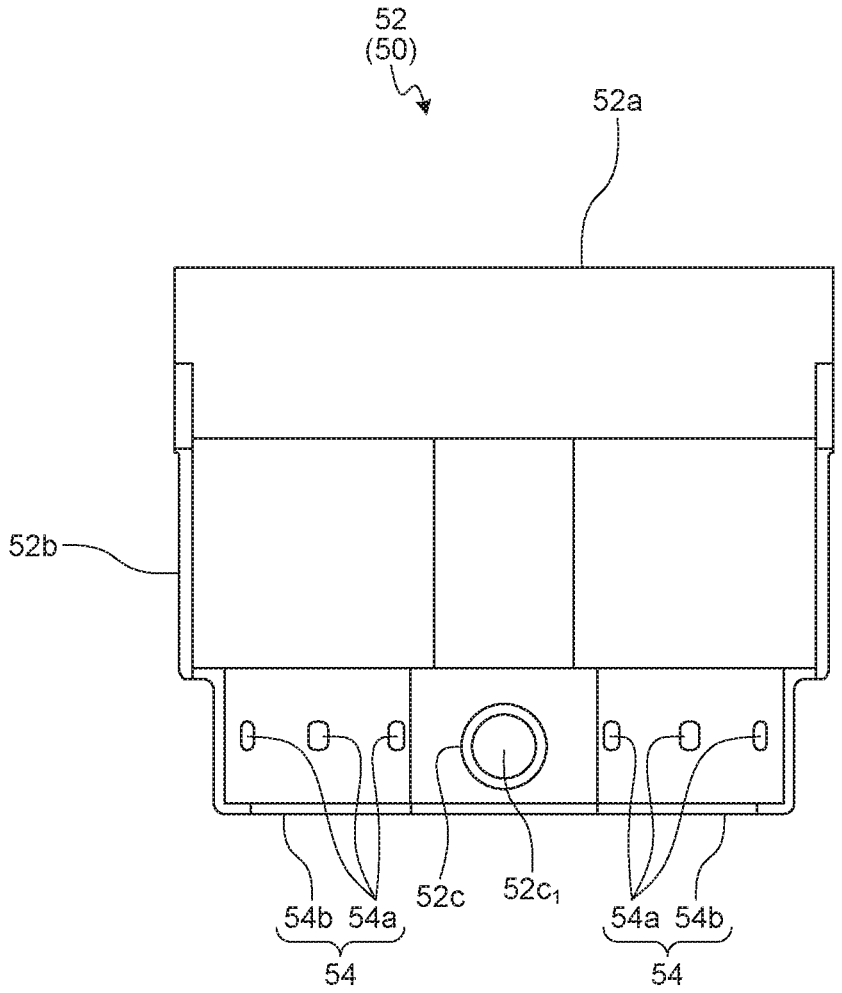
FIG. 10 is an internal plan view of a second shell.

The second shell 52 includes a boss 52*c* disposed between the two third cylinders (terminal lead-outs) 23 of the two shield terminals 20 (FIGS. 4, 5, and 10). The boss 52*c* has a through hole $52c_1$ formed to allow insertion of the male screw member 60 (FIGS. 5 and 10).

In the shield shell 50, the male screw member 60 is inserted into each of the through holes $51c_1$ and $52c_1$ respectively on the first shell 51 and the second shell 52 assembled together, and then the male screw member 60 is maintained in the inserted state. Accordingly, the connector 1 is provided with a holding member 65 that holds the male screw member 60 in a state of being inserted into the shield shell 50 (FIGS. 2, 4, 5, and 6). In this example, a shaft snap ring is used for the holding member 65. Accordingly, the male screw member 60 is provided with an annular groove 63 for holding the holding member 65 (FIG. 4).

The first pressing plate 53 and the second pressing plate 54 are configured to grip the third cylinder (terminal lead-out) 23 of the shield terminal 20 in the connector insertion/removal direction in a state where the connector mating is completed. Therefore, at least one of the first pressing plate 53 and the second pressing plate 54 includes a pressing portion projecting toward the outer peripheral surface of the third cylinder (terminal lead-out) 23 so as to apply a pressing force onto the outer peripheral surface of the third cylinder 23 in a state where the connector mating is completed. Here, both the first pressing plate 53 and the second pressing plate 54 have pressing portions 53*a* and 54*a*, respectively (FIGS. 2 to 6, 9, and 10).

The first pressing plate 53 includes a first cover 53*b* that covers the third cylinder (terminal lead-out) 23 from the connector removal direction side (FIGS. 1 to 6 and 9). The first pressing plate 53 may be provided for each of the third cylinders 23, or may include a first cover 53*b* adapted to the two third cylinders 23. The first cover 53*b* has a semicircular arc-shaped cross section orthogonal to the cylinder axis direction of the third cylinder 23. The inner peripheral surface of the exemplary first cover 53*b* is provided with a plurality of pressing portions 53*a* in the circumferential direction (FIG. 9).

Furthermore, the second pressing plate 54 includes a second cover 54*b* that covers the third cylinder (terminal lead-out) 23 from the connector insertion direction side (FIGS. 1 to 6 and 10). The second pressing plate 54 may be provided for each of the third cylinders 23, or may include a second cover 54*b* adapted to the two third cylinders 23. The second cover 54*b* has a semicircular arc-shaped cross section orthogonal to the cylinder axis direction of the third cylinder 23. The inner peripheral surface of the exemplary second cover 54*b* is provided with a plurality of pressing portions 54*a* in the circumferential direction (FIGS. 2, 4, 5, and 10).

In the exemplary shield shell 50, the first pressing plate 53 is formed integrally with the first shell 51 as a part of the first shell 51. The second pressing plate 54 is formed integrally with the second shell 52 as a part of the second shell 52. This leads to the configuration of the exemplary first shell 51 including the first cover 53*b* for each of the third cylinders 23 in addition to the above-described first shell cover 51*a*, the second shell cover 51*b*, and the receiving member 51*c*, so as to be formed as one integrated component. In the first shell 51, the two first covers 53*b* are formed with the receiving member 51*c* interposed between them. Moreover, the exemplary second shell 52 includes the second cover 54*b* for each of the third cylinders 23 in addition to the above-described first shell cover 52*a*, the second shell cover 52*b*, and the boss 52*c*, so as to be formed as one integrated component. In the second shell 52, the two second covers 54*b* are formed with the boss 52*c* interposed between them.

Figure 1:
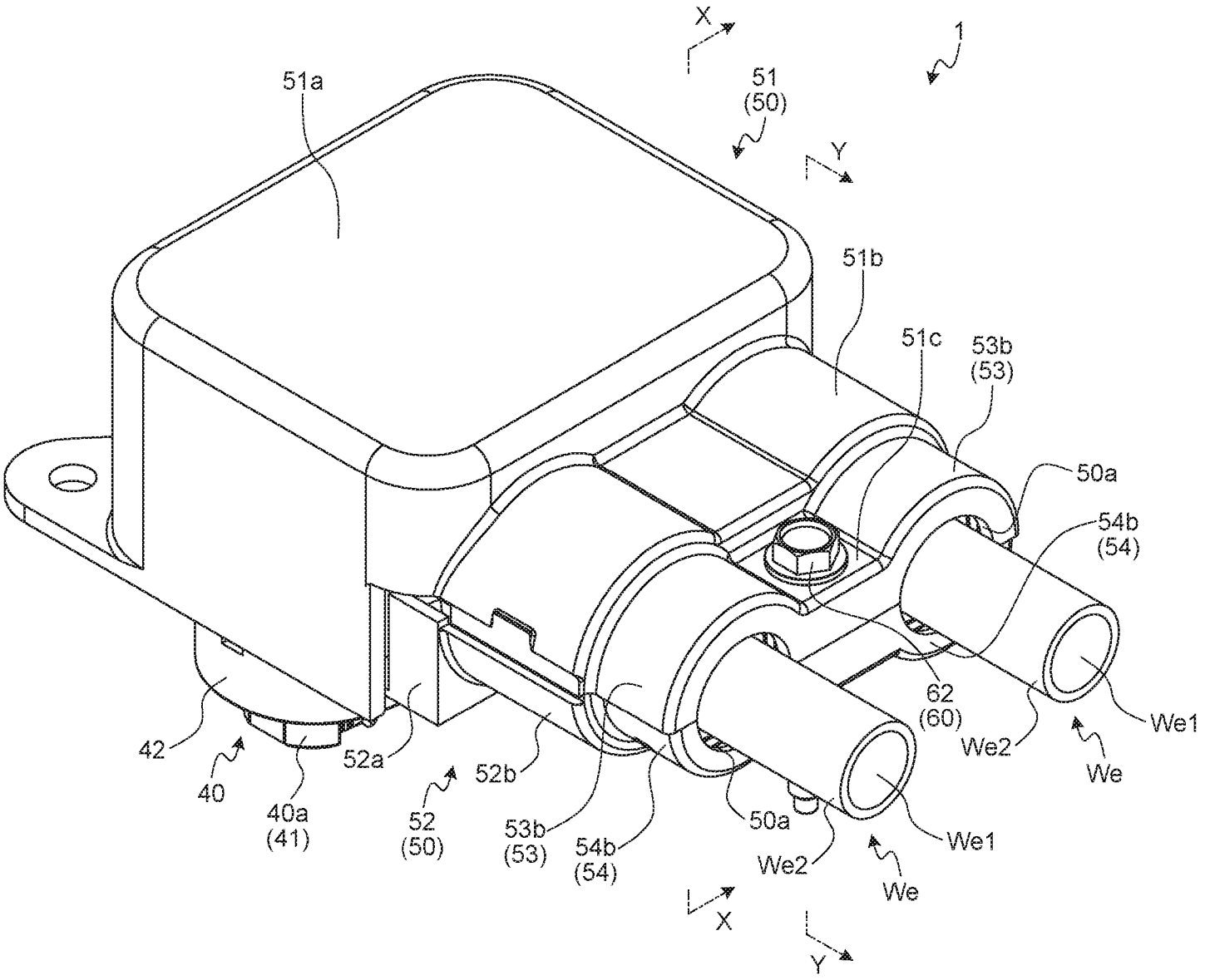
FIG. 1 is a perspective view illustrating a connector of an embodiment.

In the connector 1, the end of the electric wire We drawn out of the third cylinder (terminal lead-out) 23 can be further drawn out of the shield shell 50 in a state where the connector mating is completed. In the shield shell 50, a pair of the first cover 53*b* and the second cover 54*b* forms an outlet 50*a* for the end of the electric wire We in a state where the connector mating is completed (FIGS. 1 to 3).

In the connector 1 of the present embodiment, members such as the housing 40 are covered with the first shell 51 from the connector removal direction side and covered with the second shell 52 from the connector insertion direction side, and then the first shell 51 and the second shell 52 are assembled with each other. It is also allowable to provide a holding mechanism such as a claw (not illustrated) that holds the mutually assembled state between the first shell 51 and the second shell 52. In this connector 1, in a state where assembly of the first shell 51 and the second shell 52 with each other is completed, the third cylinder (terminal lead-out) 23 of the shield terminal 20 is gripped between the pressing portion 53*a* of the first cover 53*b* of the first pressing plate 53 and the pressing portion 54*a* of the second cover 54*b* of the second pressing plate 54. In the connector 1, the first waterproof member 31 is interposed between the shield terminal 20 and the end of the electric wire We. Therefore, in this connector 1, even when an external input is applied to the electric wire We drawn out of the shield shell 50, the electric wire We is held, inside the shield shell 50, by the first waterproof member 31, the shield terminal 20, the first pressing plate 53, and the second pressing plate 54. With this configuration, the connector 1 is capable of suppressing the transmission of the external input applied to the electric wire We to the connection terminal 10 side outside the shield shell 50, making it possible to enhance the vibration resistance.

In the connector 1 of the present embodiment, after assembling the first shell 51 and the second shell 52, the male screw member 60 and the holding member 65 is to be assembled to the shield shell 50, so as to complete all the assembling operations. The connector 1 is inserted into the counterpart connector, and the male screw member 60 is screwed into the female screw portion 502 on the counterpart connector side, whereby connector mating operation with the counterpart connector is performed while the axial force of the male screw member 60 is transmitted from the bearing surface of the head 62 to the receiving member 51*c* of the first shell 51. That is, the connector 1 can use the axial force of the male screw member 60 as an auxiliary force for connector mating until completion of the connector mating, making it possible to enhance the workability of the connector mating operation. Since the connector 1 is secured to the fixture base 501 of the counterpart connector by the male screw member 60 in a state where the connector mating is completed, making it possible to suppress the transmission of an external input to the mating connection portion for the counterpart connector, leading to enhancement of the vibration resistance.

As described above, the connector 1 of the present embodiment is configured such that the first shell 51 and the second shell 52 are assembled with each other so as to allow the third cylinder (terminal lead-out) 23 of the shield terminal 20 to be gripped between the first pressing plate 53 and the second pressing plate 54. In addition, the first waterproof member 31 is interposed between the shield terminal 20 and the end of the electric wire We inside the shield terminal 20. With this configuration, the connector 1 according to the present embodiment is capable of suppressing the transmission of the external input applied to the electric wire We to the connection terminal 10 side outside the shield shell 50, making it possible to enhance the vibration resistance conveniently. Furthermore, the connector 1 according to the present embodiment is capable of achieving the operation of generating an auxiliary force at the time of the connector mating operation and the operation of securing the connector to the counterpart connector side in the connector mating completion state with a single screw operation onto the male screw member 60, making it possible to enhance the vibration resistance conveniently with improved workability in connector mating operation.

Additionally, in this connector 1, the first shell 51 and the second shell 52 are assembled with each other, whereby the third cylinder (terminal lead-out) 23 of the shield terminal 20 is gripped between the pressing portion 53*a* of the first cover 53*b* of the first pressing plate 53 and the pressing portion 54*a* of the second cover 54*b* of the second pressing plate 54. In place of the mode of gripping or together with such a mode, it is allowable to have a configuration in which the connector 1 uses the axial force of the male screw member 60 to allow the third cylinder (terminal lead-out) 23 of the shield terminal 20 to be gripped between the first pressing plate 53 and the second pressing plate 54.

Figure 11:
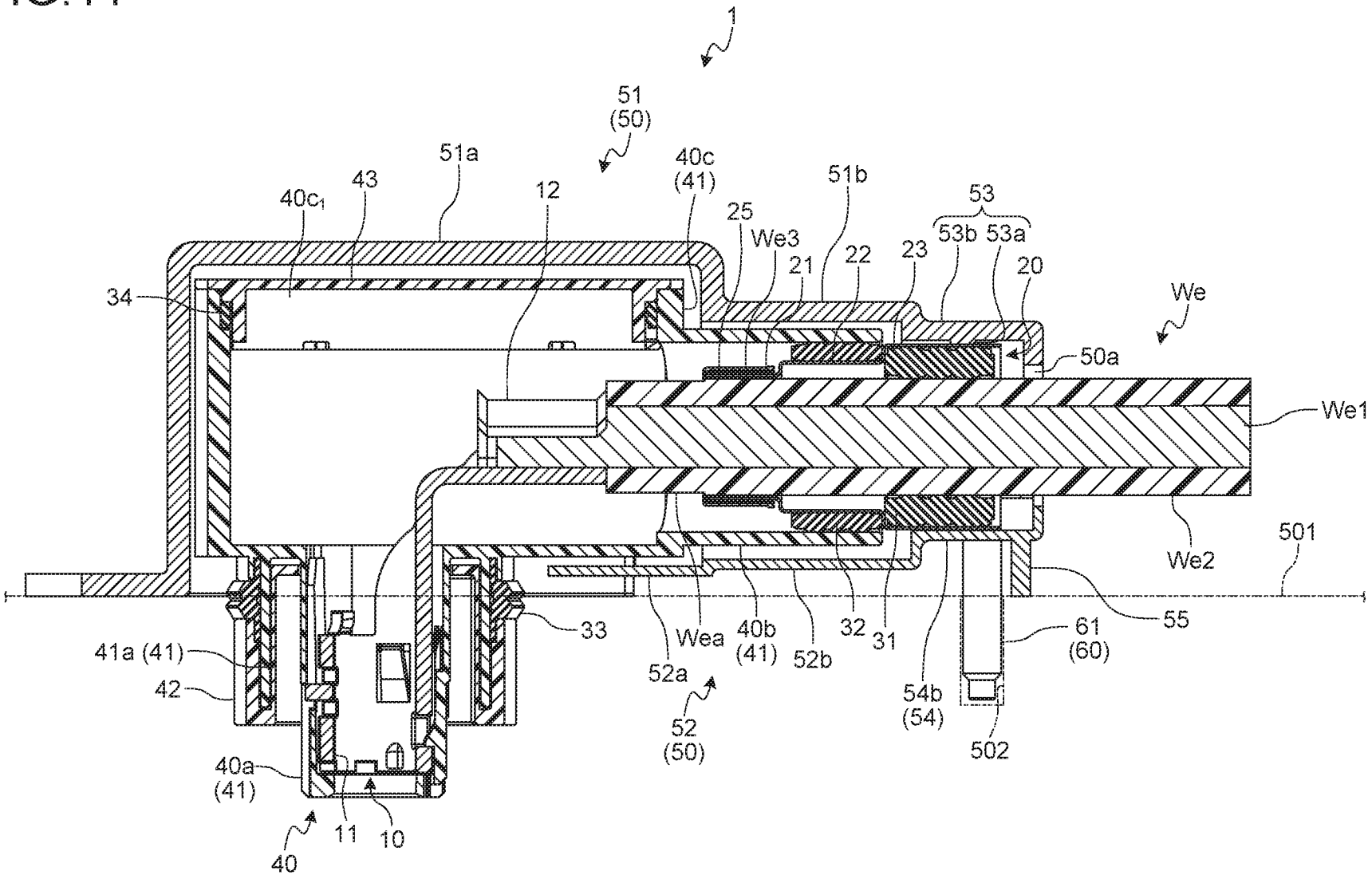
FIG. 11 is a perspective view illustrating a modification of a connector of an embodiment.

For example, the shield shell 50 is configured to apply the axial force of the male screw member 60 to the first shell 51 and apply the axial force of the male screw member 60 to the portion between the second shell 52 and the fixture base 501 on counterpart connector side in a state where the connector mating is completed, and thereby allows the third cylinder 23 to be gripped between the first pressing plate 53 and the second pressing plate 54. In this connector 1, the shield shell 50 is provided with an axial force transmitting member 55 for mutually applying the axial force of the male screw member 60 between the second shell 52 and the fixture base 501 on the counterpart connector side (FIG. 11). The axial force transmitting member 55 is configured to protrude from the second shell 52, and is brought into contact with the fixture base 501 on the counterpart connector side in a state where the connector mating is completed.

In this connector 1, the axial force of the male screw member 60 is transmitted from the bearing surface of the head 62 to the receiving member 51*c* of the first shell 51 in a state where the connector mating is completed. Furthermore, in the connector 1, the axial force of the male screw member 60 is transmitted from the fixture base 501 on the counterpart connector side to the axial force transmitting member 55 in a state where the connector mating is completed, whereby the axial force is transmitted to the second shell 52. In the connector 1, the axial force of the male screw member 60 transmitted to the first shell 51 is transmitted to the first cover 53*b* of the first pressing plate 53, and the axial force of the male screw member 60 transmitted to the second shell 52 is transmitted to the second cover 54*b* of the second pressing plate 54, whereby the third cylinder 23 is gripped between the pressing portion 53*a* of the first cover 53*b* and the pressing portion 54*a* of the second cover 54*b*.

Note that the axial force transmitting member 55 may be provided on the fixture base 501 on the counterpart connector side, and may be brought into contact with the second shell 52 in a state where the connector mating is completed.

In the connector 1 illustrated here, the first pressing plate 53 is formed integrally with the first shell 51 as a part of the first shell 51, while the second pressing plate 54 is formed integrally with the second shell 52 as a part of the second shell 52. Alternatively, the first pressing plate 53 may be formed as a component separate from the first shell 51. The second pressing plate 54 may be formed as a component separate from the second shell 52. In this case, it is desirable to preliminarily provide the above-described axial force transmitting member 55.

For example, the first pressing plate 53 has the first cover 53*b* adapted to the two third cylinders (terminal lead-outs) 23, and is provided with the through hole (not illustrated) between the respective first covers 53*b* so as to allow insertion of the male screw member 60. In addition, the second pressing plate 54 has the second cover 54*b* adapted to the two third cylinders 23, and is provided with the through hole (not illustrated) between the respective second covers 54*b* so as to allow insertion of the male screw member 60. The first shell 51 and the second shell 52 are configured to grip the first pressing plate 53 and the second pressing plate 54 in the connector insertion/removal direction in a state where the connector mating is completed. For example, the first shell 51 and the second shell 52 include a gripping portion (not illustrated) that grips the first pressing plate 53 and the second pressing plate 54 in the connector insertion/removal direction in a state where the connector mating is completed. The first shell 51 has a gripping portion for each of the first covers 53*b*, so as to allow the first cover 53*b* to be interposed between the gripping portion and the third cylinder 23. The first shell 51 has the receiving member 51*c* between the two gripping portions. The second shell 52 has a gripping portion for each of the second covers 54*b*, so as to allow the second cover 54*b* to be interposed between the gripping portion and the third cylinder 23. The second shell 52 has the boss 52*c* between the two gripping portions.

The connector 1 has a configuration in which, in a state where the connector mating is completed, the axial force of the male screw member 60 is transmitted from the bearing surface of the head 62 to the receiving member 51*c* of the first shell 51, and then the axial force is transmitted through the gripping portion of the first shell 51 to the first cover 53*b* of the first pressing plate 53. Furthermore, in the connector 1, the axial force of the male screw member 60 is transmitted from the fixture base 501 on the counterpart connector side to the axial force transmitting member 55 in a state where the connector mating is completed, whereby the axial force is transmitted to the second shell 52, and this axial force is further transmitted through the gripping portion of the second shell 52 to the second cover 54*b* of the second pressing plate 54. This configuration makes it possible, in the connector 1, to allow the third cylinder 23 to be gripped between the pressing portion 53*a* of the first cover 53*b* and the pressing portion 54*a* of the second cover 54*b*.

In the connector according to the present embodiment, the first shell and the second shell are assembled with each other, enabling the terminal lead-out of the shield terminal to be gripped between the first pressing plate and the second pressing plate. In addition, a waterproof member is interposed between the shield terminal and the end of the electric wire inside the shield terminal. With this configuration, the connector according to the present embodiment is capable of suppressing the transmission of the external input applied to the electric wire to the connection terminal side outside the shield shell, making it possible to conveniently enhance the vibration resistance. Furthermore, the connector according to the present embodiment is capable of achieving operation of generating an auxiliary force at the time of connector mating operation and the operation of securing the connector to the counterpart connector side in a state where the connector mating is completed just with a single screw operation onto the male screw member, making it possible to enhance the vibration resistance conveniently with improved workability in connector mating operation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a conductive connection terminal including a terminal connecting portion that is inserted into or removed from a counterpart connection terminal in a connector insertion/removal direction with respect to a counterpart connector and including an electric wire connecting portion that is physically and electrically connected to an end of an electric wire;

a conductive cylindrical shield terminal that covers the end of the electric wire coaxially from an outer peripheral surface side and configured to be physically and electrically connected to a shield member of the electric wire;

an insulating cylindrical waterproof member coaxially interposed between the shield terminal and the end of the electric wire;

an insulating housing including a first container that houses the connection terminal and including a second container that houses the shield terminal and the end of the electric wire aligned along an axis in a direction orthogonal to the connector insertion/removal direction and that is configured to allow a terminal lead-out of the shield terminal and an electric wire lead-out of the end of the electric wire to be drawn outward in the orthogonal direction;

a conductive shield shell that houses the housing, the terminal lead-out, and the wire lead-out; and a male screw member that secures the shield shell to a fixture base on the counterpart connector side in a state where the connector mating with the counterpart connector is completed when the connector insertion/removal direction is defined as a screw axis, wherein the shield shell includes a first shell and a second shell each of which having a through hole respectively that allows insertion of the male screw member and configured to sandwich the housing in the connector insertion/removal direction, and includes a first pressing plate and a second pressing plate that grip the terminal lead-out in the connector insertion/removal direction in the state where the connector mating is completed.

2. The connector according to claim 1, wherein at least one of the first pressing plate and the second pressing plate includes a pressing portion projecting toward an outer peripheral surface of the terminal lead-out so as to apply a pressing force onto the outer peripheral surface of the terminal lead-out in a state where the connector mating is completed.

3. The connector according to claim 1, wherein the first pressing plate is formed integrally with the first shell as a part of the first shell, and the second pressing plate is formed integrally with the second shell as a part of the second shell.

4. The connector according to claim 2, wherein the first pressing plate is formed integrally with the first shell as a part of the first shell, and the second pressing plate is formed integrally with the second shell as a part of the second shell.

5. The connector according to claim 1, wherein the first pressing plate is formed as a component separate from the first shell, the second pressing plate is formed as a component separate from the second shell, and the first shell and the second shell are configured to allow the first pressing plate and the second pressing plate to be gripped in the connector insertion/removal direction in a state where the connector mating is completed.

6. The connector according to claim 2, wherein the first pressing plate is formed as a component separate from the first shell, the second pressing plate is formed as a component separate from the second shell, and the first shell and the second shell are configured to allow the first pressing plate and the second pressing plate to be gripped in the connector insertion/removal direction in a state where the connector mating is completed.

* * * * *